US005169153A

United States Patent [19]

Levy et al.

[11] Patent Number: 5,169,153

[45] Date of Patent: Dec. 8, 1992

[54] THREE-WAY DIMENSIONAL BOARD GAME WITH AUDIBLE SOUND GENERATOR AND METHOD OF PLAY

[76] Inventors: Richard C. Levy, P.O. Box 34828, Bethesda, Md. 20827; Richard J. Maddocks, 302 Lexington Dr., Silver Spring, Md. 20901

[21] Appl. No.: 833,696

[22] Filed: Feb. 11, 1992

[51] Int. Cl.[5] ..... A63F 3/00

[52] U.S. Cl. ..... 273/241; 273/287; 273/288

[58] Field of Search ..... 273/241, 287, 288, 276; 446/168

[56] References Cited

U.S. PATENT DOCUMENTS

| | | | |
|---|---|---|---|
| 455,671 | 7/1891 | Sellers | 446/192 |
| 1,565,723 | 12/1925 | Evans | 446/194 |
| 1,642,956 | 9/1927 | Hutnikow | 446/196 |
| 2,299,023 | 10/1942 | Marcus | 46/187 |
| 2,558,237 | 6/1951 | Cohn et al. | 46/187 |
| 3,184,237 | 5/1965 | Riva | 273/241 |
| 3,201,129 | 8/1965 | McFarland et al. | 273/287 |
| 3,649,021 | 3/1972 | Hayes | 273/243 |
| 3,896,584 | 7/1975 | Terzian et al. | 46/118 |
| 4,343,475 | 8/1982 | Stader | 273/276 |
| 4,348,191 | 9/1982 | Lipsitz et al. | 434/308 |
| 4,443,201 | 4/1984 | Diefenbach | 434/259 |

FOREIGN PATENT DOCUMENTS

| | | | |
|---|---|---|---|
| 500700 | 11/1954 | Italy . | |
| 2226767 | 7/1990 | United Kingdom | 273/241 |

*Primary Examiner*—Benjamin H. Layno
*Attorney, Agent, or Firm*—Nixon & Vanderhye

[57] ABSTRACT

The three-dimensional board game includes a plurality of playing surfaces at different elevations relative to one another, with each surface having playing spaces forming part of the predetermined path of movement of playing pieces along the playing surfaces from start to finish. Tubes depend from the playing surfaces terminating at their lower ends adjacent lower playing surfaces whereby playing pieces inserted into the tubes at one level descend through the tubes for egress at the playing surface at another level. The playing pieces or tubes are provided with air passageways with sound generators therein to provide an audible sound upon descent of the playing pieces within the tubes.

15 Claims, 3 Drawing Sheets

THREE-WAY DIMENSIONAL BOARD GAME WITH AUDIBLE SOUND GENERATOR AND METHOD OF PLAY

BACKGROUND AND SUMMARY OF THE INVENTION

The present invention relates to a board game for play by small children and particularly relates to a progression or race-type game characterized by a three-dimensional game board with game playing surfaces at different elevations and playing pieces which, in cooperation with tubes interconnecting the playing surfaces at different elevations, provide an audible sound when disposed within the tubes.

In a great number of board games, playing pieces are advanced about the board along a predetermined path in accordance with the roll of a die or dice or the spin of a spinner which indicates the number of spaces or squares, hereafter spaces, playing pieces may advance along the playing surface. Certain of these games comprise what are known as progression or race games. In this type of game, the objective is to advance an individual's playing piece from a starting position along the predetermined path in accordance with the roll of the die or dice or spin of the spinner and to reach an end space or finish along the playing path before any other player reaches that end space. Certain of these games have playing spaces along the predetermined path which indicate that the playing piece should be set back one or more spaces. That is, when the player lands on certain spaces, the player's piece is involuntarily returned to a previous position closer to the start of the game than to the end space of the game. Those players able to avoid such spaces or minimize the number of times they land on those spaces are thus able to maintain faster forward progress to the end space of the game than those players whose pieces land on such spaces.

The present invention uses those principles and provides a board game which is three-dimensional in nature having playing surfaces at different elevations relative to one another. The three-dimensional board game of the present invention provides a predetermined path of movement for the playing pieces from one playing surface at one elevation to the next playing surface at another, preferably the next, elevation and so on, until the uppermost elevation containing the end space is obtained. Thus, a player starts his piece along the lowermost playing surface, and in accordance with the roll of the die or dice or the spin of a spinner, advances his piece along a predetermined path comprised of multiple spaces. Eventually the player advances his piece to a space on the one playing surface which indicates the piece should be advanced to the next elevated playing surface. The player then continues to advance his playing piece along the spaces of that next elevated playing surface and eventually advances the piece to the next superposed playing surface and ultimately to the end space, i.e., attains the objective of the game.

While the three-dimensional aspect of the board game is per se quite different than the two-dimensional aspect of conventional board games of this type, another feature of the present invention resides in the provision of tubes extending from one playing surface to adjacent another playing surface. More particularly, each tube has an open upper end disposed in a playing surface at one elevational and depends from that playing surface toward a lower playing surface, terminating in a lower end spaced above the lower playing surface. The lower end of each tube is provided with a releasable closure cap. It will be appreciated that the tubes may extend from a playing surface at one elevational to the playing surface at the next lower elevational or may extend through one or more playing surfaces at different elevations to terminate at a playing surface two or more playing surfaces removed from the playing surface containing the upper end of the tube. For example, where there are base, intermediate and upper level playing surfaces, a tube may extend from the upper playing surface to a location spaced above and adjacent to the intermediate playing surface. Another tube may extend from the upper playing surface through the intermediate playing surface, terminating at its lower end adjacent to and spaced above the lower playing surface. Likewise, a tube may extend from the intermediate playing surface downwardly to terminate adjacent to the base playing surface. As will be appreciated, more than three levels of playing surfaces may be employed.

The upper end of each of the tubes opens through a playing space along the predetermined path of movement of the playing pieces along that playing surface. Consequently, when a player rolls the die or spins a spinner to determine the extent to which his playing piece may be advanced, his playing piece, at least on the levels above the base playing surface, may land on a space containing the open upper end of the depending tube. If that occurs, the player places his playing piece in the tube and the tube directs the playing piece, as it descends through the tube, to a lower playing surface. Upon removal of the closure cap from the lower end of the tube, for example, by pivoting the closure cap to an open position relative to the tube, the playing piece may be removed from the tube and placed on a specified space on the lower playing surface. In this manner, the playing piece has been effectively involuntarily set back to a different level closer to the start rather than to the finish of the game. It will be appreciated that the tubes may depend vertically from the playing surfaces or be inclined to the vertical.

To afford added excitement and interest to the game, the playing pieces cooperate with the tubes, when a playing piece is inserted into the upper end of a tube, to define an air chamber within the tube. An audible sound generator is provided responsive to the passage of air through an air passageway in the generator to provide an audible signal indicating the passage of the playing piece through the tube. Thus, the playing piece itself may have a discrete air passageway containing a reed or other sound-generating device. The reed or device is therefore responsive to the passage of air from the air chamber through the passageway to generate the audible sound. Alternatively, there may be provided an air passageway adjacent the lower end of the tube in communication with the air chamber. Thus, as a playing piece descends within a tube, air from the chamber passes into the passageway and activates a sound generator located in the passageway. Consequently, any time a playing piece lands on a space having a tube opening, the playing piece is dropped into the tube, causing an audible sound as it descends through the tube for discharge adjacent its lower end.

By forming the tubes of like cross-sectional areas and the playing pieces of similar like cross-sectional areas, the playing pieces may form a substantial seal with the side walls of the tube whereby the air in the chamber below the playing piece may be forced through the passageways containing the sound generator. Consequently, any playing piece may be disposed in any tube and cause the audible sound to be emitted.

It will be appreciated that the progression of the pieces need not necessarily extend from a playing surface at one elevation to a playing surface at a higher elevation. The game may start at a higher playing surface and progress to lower playing surfaces. In a game of that type, the playing pieces landing on the spaces containing the upper ends of the tube would advantageously descend to playing spaces further advanced along the predetermined playing path, hence desirably advancing the piece at a faster rate to the end space or finish at the lower elevation. The audible sound generated would thus indicate progress toward the game's objective, rather than a setback toward that objective, as in the previously described game.

In a preferred embodiment according to the present invention, there is provided a game, comprising a game board having a plurality of game playing surfaces disposed at different elevations relative to one another and a plurality of tubes having upper and lower ends, with each tube extending from its upper end adjacent one of the playing surfaces toward a playing surface at a lower elevation thereof with the lower end of the tube terminating adjacent the playing surface at the lower elevation thereof. Also provided are means for releasably closing the lower ends of the tubes, a plurality of playing pieces for disposition on the playing surfaces and within the tubes through the open upper ends thereof, means cooperable between the playing pieces, the tubes and the closing means, upon disposition of the playing pieces into the tubes through the open upper ends thereof, defining air chambers within the tubes between the playing pieces and the lower ends of the tubes as the playing pieces descend within the tubes. Means are also provided responsive to a flow of air from each the air chamber as the playing piece descends within the tubes for emitting an audible sound, the playing pieces being removable from the tubes upon opening the closing means adjacent the lower ends of the tubes for disposition of the pieces on the playing surfaces.

In a further preferred embodiment according to the present invention, there is provided a method of playing a game comprising the steps of providing a game board having a plurality of game playing surfaces disposed at different elevations relative to one another, with each surface having a plurality of playing spaces forming a predetermined path along the game board from a start to a finish, disposing a plurality of tubes extending between the playing surfaces at different elevations thereof, the tubes having upper ends opening through selected playing spaces in the playing surfaces, advancing playing pieces along the playing spaces of the predetermined path, releasably closing the lower ends of the tubes, disposing at least one of the playing pieces in the upper end of a tube for descent through the tube to a playing surface at a lower elevation thereof and generating an audible sound in response to the descent of the one playing piece through the tube by directing air in the tube ahead of the descending playing piece through a passageway having an air-responsive sound generator therein.

Accordingly, it is a primary object of the present invention to provide a novel and improved three-dimensional board game of the race or progression type and method of play wherein playing pieces may be setback or advanced a predetermined number of spaces along a predetermined game path by changing their location from one playing surface elevation to another playing surface elevation, while simultaneously emitting an audible sound signal.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
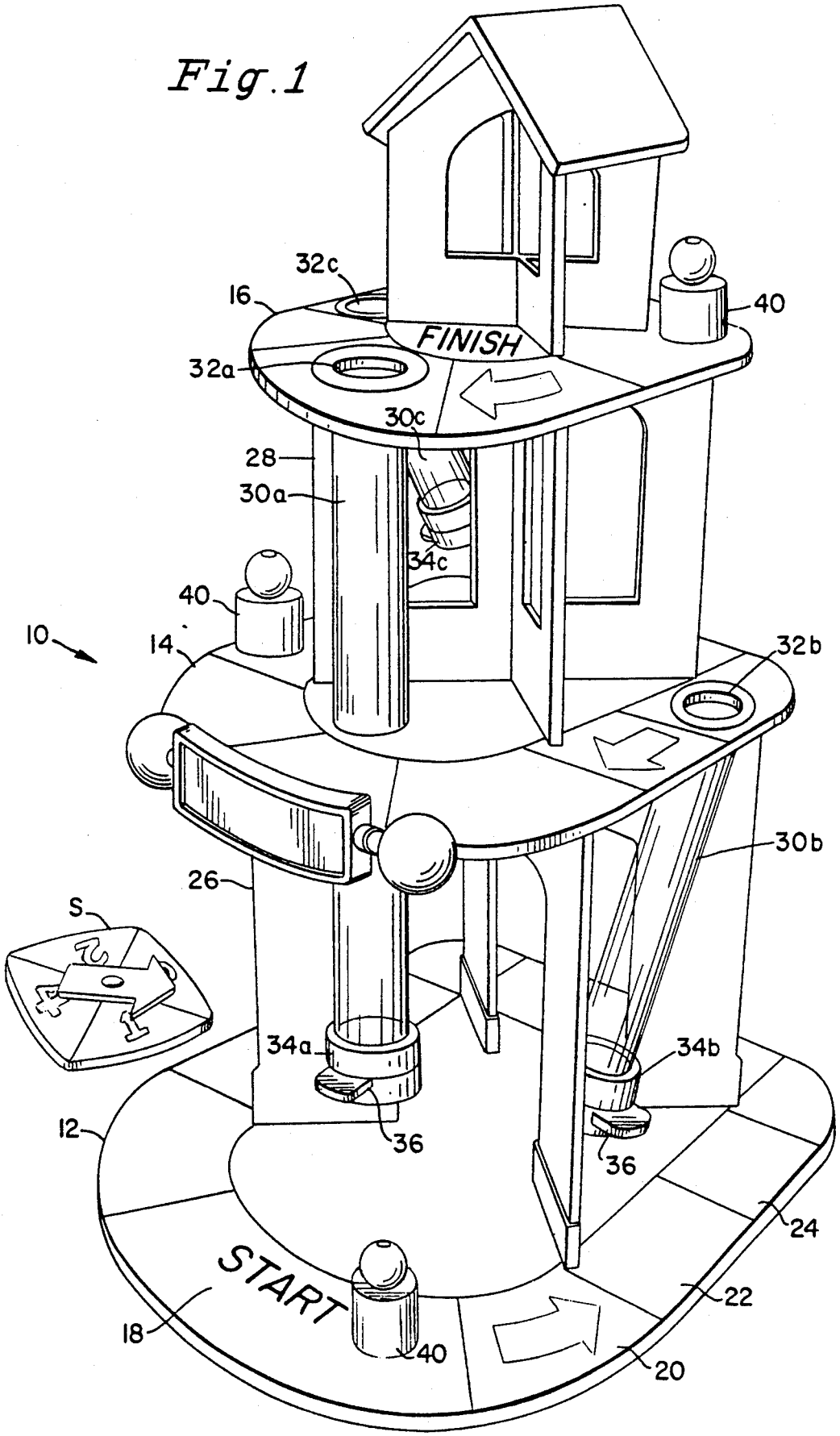
FIG. 1 is a perspective view of a three-dimensional board game according to the present invention.

Referring now to the drawings, particularly to FIG. 1, there is illustrated a three-dimensional board game according to the present invention and generally designated 10. Game board 10 includes a multiplicity of boards constituting playing surfaces disposed at different elevations relative to one another. For example, in FIG. 1, three playing board surfaces are illustrated, e.g., a lower or base playing board surface 12, an intermediate playing board surface 14 and an upper playing board surface 16. It will be appreciated, however, that additional playing board surfaces at different elevations can be provided or even fewer, i.e., two playing board surfaces at different elevations. Each of the playing surfaces is provided with a predetermined path consisting of a sequence of spaces along which the playing pieces are advanced or set back. In the specific example, a start space is indicated 18 and a number of sequentially arranged additional spaces 20, 22, 24, etc., are disposed about the playing surfaces, forming a predetermined path along which the playing pieces may be advanced or set back. Additionally, one or more of the playing spaces may constitute an indication to the player to advance his playing piece to the next level of playing board surfaces, e.g., advance the playing piece from the base playing surface 12 to the intermediate playing surface 14 or from the latter playing surface to the uppermost playing surface 16. Upon advancement of each playing piece along the predetermined path on each playing surface and from one playing surface to the next, the playing pieces are advanced until the end space or finish is reached, e.g., in the finish space in the uppermost playing board surface 16. It will be appreciated that there is support structure in the form of upstanding structural elements 26 and 28 supporting the playing surfaces at different elevations relative to one another.

It is a particular feature of the present invention that tubes are provided extending from the playing surface at one elevation toward the playing surface at another elevation. Each tube 30 is preferably formed of a transparent, e.g., plastic material, and has an upper end 32 opening through a playing space of a playing surface. Tube 30 depends from the playing surface and terminates at its lower end 34 in a closure cap 36 spaced from and above the lower playing surface. A bracket 35 is used to anchor the elevated lower end of the tubes 30 to the playing surfaces. It will be appreciated that each tube may extend only one elevation, i.e., from one playing surface to the playing surface next below the one playing surface, or may extend through two or more elevations, e.g., extend from one playing surface through the playing surface next below and terminate at a playing surface two elevations below the upper end of the tube. For example, in the illustration, tube 30*a* has an upper end 32*a* opening through upper playing surface 16. Tube 30*a* extends downwardly through the intermediate playing surface 14, terminating at its lower end 34*a* in a closure cap 36*a* spaced above the lowermost playing surface 12, for reasons which will become apparent from the ensuing description. Alternatively, the tubes 30 may extend through only one elevation. For example, the tube 30*b* has an upper end 32*b* opening through the intermediate playing surface 14 and terminating at its lower end 34*b* in a cap 36*b* spaced above and adjacent the lower playing surface 12. Similarly, tube 30*c* may extend from its open upper end 32*c* to its lower end 34*c* adjacent intermediate playing surface 14.

It will also be appreciated that tubes 30 may be aligned vertically or at an angle to the vertical as indicated by the tubes 30*b* and 30*c*. Furthermore, while the preferred cross-section of the tubes is circular, they may be any other cross-sectional shape, such as square, rectangular, oval or the like, provided that the cross-sectional shapes are identical to one another and the playing pieces correspond in cross-sectional shape thereto, as noted further below.

Figure 2:
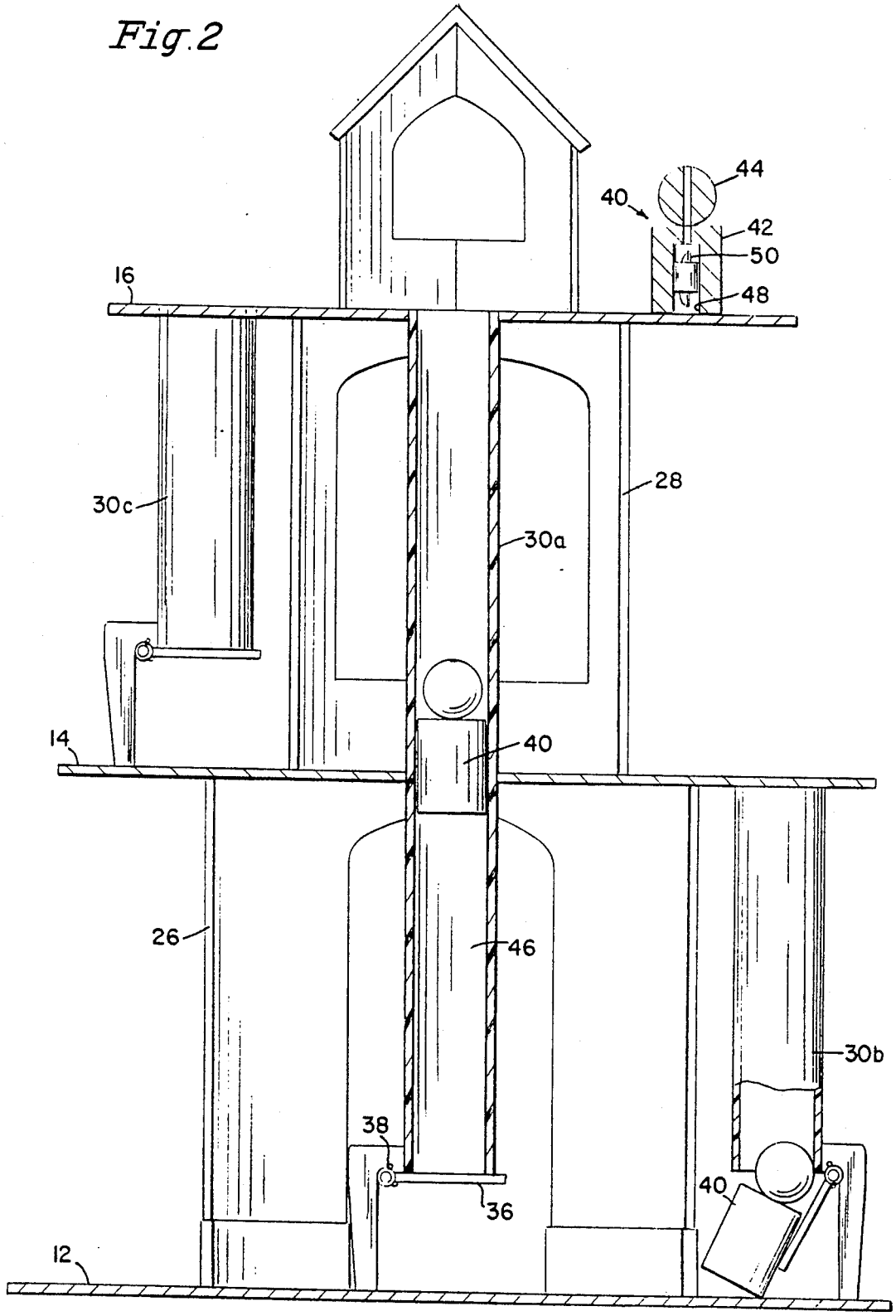
FIG. 2 is a schematic vertical cross-sectional view of the board game hereof illustrating the playing pieces, playing surfaces and tubes interconnecting the playing surfaces.

Playing pieces 40 are generally conformal in horizontal cross-sectional configuration to the cross-sectional shape of the tubes 30. For example, as indicated in FIG. 2, each playing piece may comprise a generally cylindrical base 42 with a headpiece 44 of smaller cross-sectional diameter. The cross-sectional shape and dimension of the base 42 corresponds to the cross-sectional shape and dimension of the tubes 30, each tube and piece being identical in cross-sectional shape and dimension. The playing pieces may, depending upon the particular game, constitute figurines in shape. In that instance, a portion of the figurine will correspond in dimension and shape to the dimension and shape of the tubes, for reasons which will now be explained. Each of the tubes 30 has a lower closure cap 36 which is movable between a position closing the lower end of tube 36 and a position opening the lower end of tube 30. In a preferred form, the closure cap may be pivoted to the lower end of a tube about a horizontal pivot axis and a helical spring 38 may be provided to bias the cap 36 into closing engagement about the lower end of tube 30. Alternatively, the closure cap may be pivoted about a vertical axis or slidable transversely between tube open and tube closed positions. The lower end of the tubes are spaced above the adjacent playing surface a distance sufficient such that when the closure cap 36 is opened, the playing piece may be removed from the tube for further play on that playing surface. Additionally, it will be appreciated from a review of FIG. 2 that once the playing piece 40 is disposed in the upper end of the tube, the playing piece, the tube wall below the playing piece and the cap 36 form a substantially sealed air chamber 46. Thus, when the playing piece is disposed in the tube, the air in chamber 46 as the playing piece descends toward the lower end of the tube is compressed. A salient feature of the present invention resides in the emission of an audible sound upon descent of the playing piece within the tube. To provide for the audible sound, the playing piece, as illustrated in FIG. 2, may include an air passageway 48 in which there is disposed a sound-producing reed responsive to the passage of air through passageway 48 to provide an audible sound signal. For example, the audible sound-producing generator may be of the type disclosed in U.S. Pat. No. 4,443,201. Consequently, as the playing piece 40 descends within the tube, the compressed air in chamber 46 passes through passageway 48 and acts on the reed 50 to emit the audible sound. When the playing piece reaches the bottom of the tube, the player may open the closure cap 36 to remove the playing piece and place the playing piece on the indicated playing space, as directed in accordance with the instructions in the game.

Figure 4:
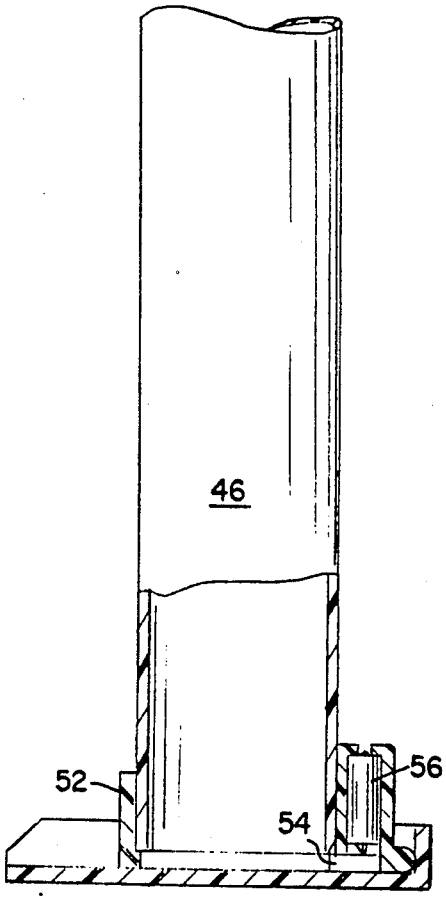
FIG. 4 is an enlarged fragmentary cross-sectional view thereof.
Figure 3:
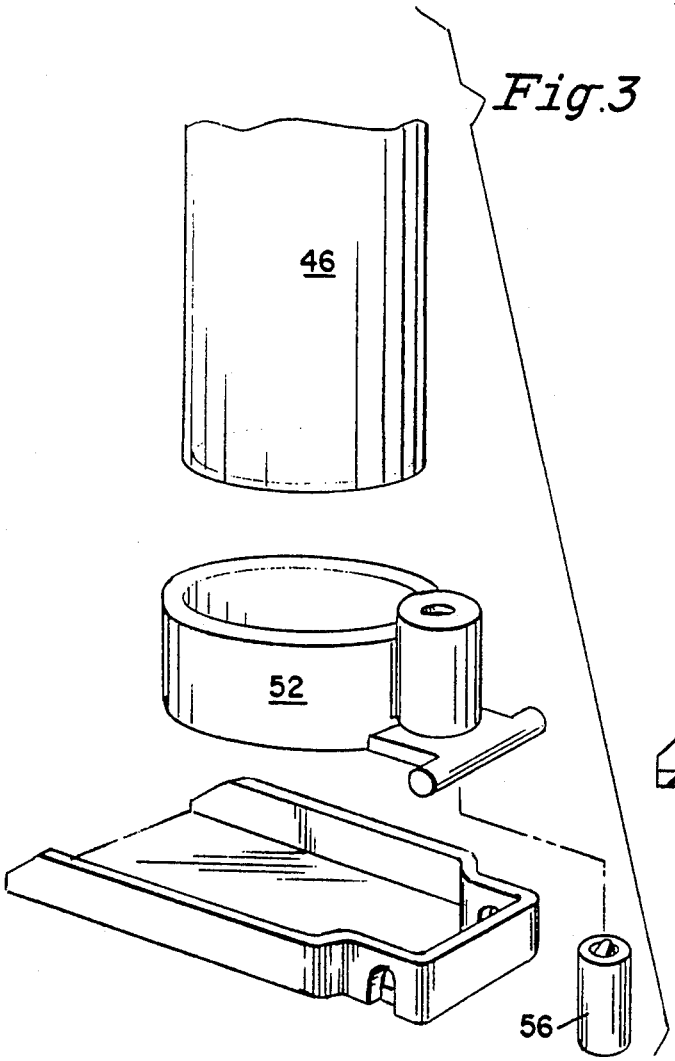
FIG. 3 is a fragmentary perspective view of the lower end of a tube according to a second embodiment hereof.

Alternatively, and with reference to FIGS. 3 and 4, the sound may be generated by a signalling device placed at the lower end of the tube adjacent the closure cap. For example, the closure cap 36 may include a flange 52 about the lower end of the tube which, not only carries the pivoting hinge for the cap, but carries an air passageway 54 in communication with air chamber 46. A reed may be disposed in the passageway 54. Consequently, as the playing piece descends within the tube, the compressed air in chamber 46 passes through passageway 54 and past the reed 56 to emit the audible sound until the playing piece rests at the bottom of the tube against the closed closure cap.

To recapitulate, the three-dimensional board game of the present invention provides for multiple playing surfaces at different elevations interconnected by support structure, with each playing surface, with the exception of the lowermost playing surface, having one or more tubes depending therefrom toward a lower playing surface. The playing surfaces are arranged in the form of squares or playing spaces whereby playing pieces are moved along the playing surfaces in a progressive fashion in accordance with the throw of a die or a spinner, spinner S being illustrated in FIG. 1. When the playing piece is advanced to land on a playing space also containing the open upper end of a tube, the player places the playing piece in the upper end of the tube, permitting it to drop through the tube to the lower end of the tube at a different playing elevation. In the course of descending through the tube, there is generated an audible sound which signifies the player's movement of his or her playing piece from one playing surface elevation to another. When the playing piece reaches the bottom of the tube, the closure cap is opened and the playing piece is placed on the board along the predetermined path, as indicated by the playing instructions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A game, comprising:

a game board having a plurality of game playing surfaces disposed at different elevations relative to one another;

a plurality of tubes having upper and lower ends;

each tube extending from its upper end adjacent one of said playing surfaces toward a playing surface at a lower elevation thereof with the lower end of the tube terminating adjacent the playing surface at said lower elevation thereof;

means for releasably closing the lower ends of said tubes;

a plurality of playing pieces for disposition on said playing surfaces and within said tubes through the open upper ends thereof;

means cooperable between said playing pieces, said tubes and said closing means, upon disposition of said playing pieces into said tubes through the open upper ends thereof, defining air chambers within the tubes between the playing pieces and the lower ends of the tubes as the playing pieces descend within the tubes; and means responsive to a flow of air from each said air chamber as the playing piece descends within the tube for emitting an audible sound;

said playing pieces being removable from said tubes upon opening said closing means adjacent the lower ends of said tubes for disposition of the pieces on said playing surfaces.

2. A game according to claim 1 wherein at least one of said tubes extends from its upper end adjacent one of said playing surfaces through a second playing surface next below said one playing surface, terminating at its lower end adjacent a third playing surface below said second playing surface.

3. A game according to claim 1 wherein at least one of said tubes extends at an angle inclined to the vertical.

4. A game according to claim 1 wherein said closing means for each tube includes a closure cap movable between positions opening the lower end of said tube and closing said lower end of said tube.

5. A game according to claim 4 including means pivotably mounting said cap to said tube and means cooperable between said cap and said tube for biasing said pivoted cap into its closed position.

6. A game according to claim 1 wherein each of said playing pieces includes a passageway in communication with said chamber and an audible sound generator responsive to movement of air through said passageway.

7. A game according to claim 1 wherein said tube includes an air passageway adjacent its lower end in communication with said air chamber and an audible sound generator responsive to movement of air through said passageway.

8. A game according to claim 1 wherein at least one of said tubes extends from its upper end adjacent one of said playing surfaces through a second playing surface next below said one playing surface, terminating at its lower end adjacent a third playing surface next below said second playing surface, at least one of said tubes extending at an angle inclined to the vertical.

9. A game according to claim 1 wherein said tubes and said playing pieces have substantially like cross-sectional areas whereby any one of said playing pieces may be disposed in any one of said tubes in substantial sealing relative therebetween.

10. A method of playing a game comprising the steps of:

providing a game board having a plurality of game playing surfaces disposed at different elevations relative to one another, with each surface having a plurality of playing spaces forming a predetermined path along the game board from a start to a finish;

disposing a plurality of tubes extending between the playing surfaces at different elevations thereof, the tubes having upper ends opening through selected playing spaces in said playing surfaces;

advancing playing pieces along the playing spaces of the predetermined path;

releasably closing lower ends of the tubes;

disposing at least one of the playing pieces in the upper end of a tube for descent through the tube to a playing surface at a lower elevation thereof; and generating an audible sound in response to the descent of the one playing piece through the tube by directing air in the tube ahead of the descending playing piece through a passageway having an air-responsive sound generator therein.

11. A method according to claim 10 including forming the playing pieces and the interior walls of the tube of substantially like cross-sections to enable each playing piece to be disposed in each tube in a substantial sealing relation therebetween.

12. A method according to claim 10 including disposing at least one of said tubes at an angle to the vertical.

13. A method according to claim 10 including disposing one of said playing surfaces through a second playing surface next below said one playing surface to terminate at its lower end adjacent a third playing surface below said second playing surface.

14. A method according to claim 10 including disposing an air passageway through each playing piece and the air-responsive sound generator in said air passageway of each playing piece.

15. A method according to claim 10 including disposing an air passageway through a portion of the lower end of each tube and the air-responsive sound generator in said air passageway portion of each tube.

* * * * *